United States Patent [19]

Munson

[11] 4,353,307

[45] Oct. 12, 1982

[54] TOWING DEVICE FOR USE IN THE SURF

[76] Inventor: Bruce H. Munson, 334 Emerson Cir., Corpus Christi, Tex. 78415

[21] Appl. No.: 135,106

[22] Filed: Mar. 28, 1980

[51] Int. Cl.[3] ..... B61B 11/00; B66D 1/36

[52] U.S. Cl. ..... 104/183; 43/27.4; 104/173 R; 254/334; 254/338

[58] Field of Search ..... 9/8 R, 14; 114/241; 254/334, 338, 394; 43/4, 6.5, 8, 27.2, 27.4; 104/173 R, 173 ST, 230, 229, 114, 110, 117, 183

[56] References Cited

U.S. PATENT DOCUMENTS

| | | | |
|---|---|---|---|
| 84,592 | 12/1868 | Street | 9/14 |
| 1,414,794 | 5/1922 | Stapienski | 254/388 |
| 1,546,031 | 7/1925 | Schofield | 9/14 |
| 2,951,307 | 9/1960 | Joy | 43/27.4 |
| 3,052,470 | 9/1962 | Pomagalski | 104/173 ST |
| 3,103,344 | 9/1963 | Figge | 254/338 |
| 3,338,180 | 8/1967 | Stecker | 104/173 R |
| 3,538,855 | 11/1970 | Cyr | 104/173 ST |

*Primary Examiner*—Billy S. Taylor

*Attorney, Agent, or Firm*—G. Turner Moller

[57] ABSTRACT

There is provided an apparatus for towing surfers out into a body of water. The device includes an anchor in the body of water and a buoyant member connected thereto carrying a pulley adjacent the surface of the water. An endless flexible line is reeved about the pulley and has two runs extending from the buoyant member to a location adjacent the shore. The flexible line is wrapped about a windlass or capstan which is driven in a manner to move one of the runs in a direction away from the shore and toward the anchor. A plurality of drop lines are connected to the endless line which may be grasped by the surfer who is thereupon towed from the shore into the body of water.

7 Claims, 4 Drawing Figures

TOWING DEVICE FOR USE IN THE SURF

This invention relates to a device for towing individuals from adjacent a shore out into a body of water.

Surfing has, of course, become widely popular. Naturally, the joy of surfing lies in riding the waves toward the shore. The onerous, boring and time consuming aspect of surfing lies in paddling one's board out into the surf. As will be more fully apparent hereinafter, one of the main objects of this invention is to provide a simple, effective and expeditious means of towing a surfer from the shore out into the surf. Such a device will necessarily enhance enjoyment by the surfer since many more pleasurable runs may be made in a given period of time without requiring the onerous and boring task of paddling back out into the surf.

Although there are no known patent disclosures aimed at towing surfers out into a body of water, the disclosure in U.S. Pat. No. 797,223 is of some interest. Of more general interest are U.S. Pat. Nos. 84,592; 541,789; 800,926; 946,798; 1,380,026; 2,716,959; 3,093,848 and 3,101,491.

It is also known, in areas of high tides, to moor a small boat to an endless line extending out into the water to a buoy and manually pull the endless line so that the boat is pulled out adjacent the buoy. When the tide falls, the boat remains in the water rather than being stranded on shore.

In summary, this invention comprises an apparatus for towing individuals from adjacent a shore out into an adjacent body of water. The apparatus comprises an anchor in the body of water, a buoyant member connected to the anchor and having at least one pulley thereon adjacent the surface of the water, an endless flexible line reeved about the pulley and having two runs extending from the buoyant member to a location adjacent the shore and means for endlessly moving the flexible line for moving one of the runs in a direction away from the shore.

It is an object of this invention to provide a simple and effective means of towing individuals out into a body of water.

Other objects and advantages of this invention will become more fully apparent as this description proceeds, reference being made to the accompanying drawings and appended claims.

IN THE DRAWINGS

Figure 1:
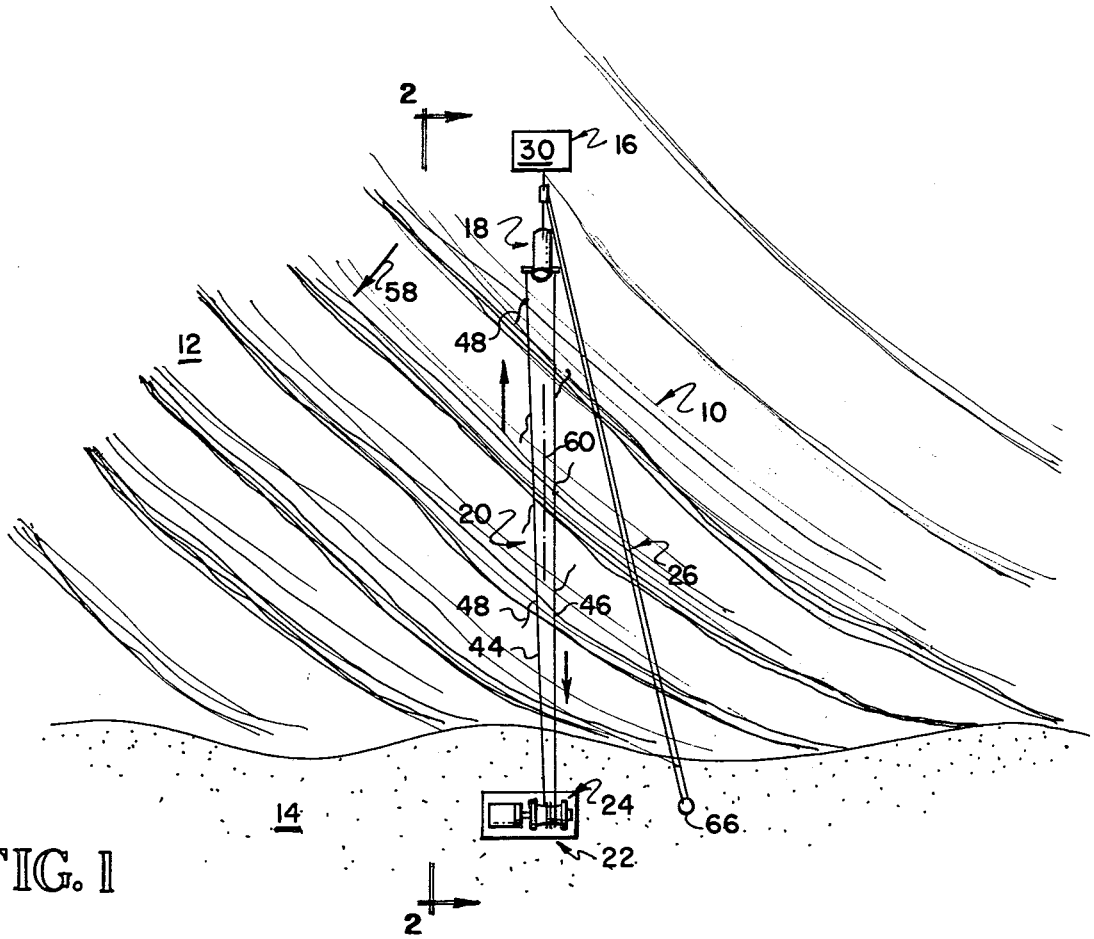
FIG. 1 is a top plan view of an installation of this invention.
Figure 2:
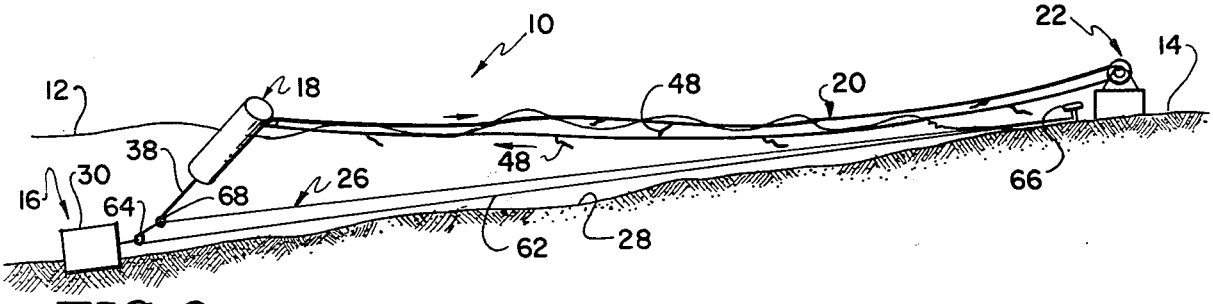
FIG. 2 is a longitudinal cross-section perpendicular to the beach, taken along line 2—2 of FIG. 1 as viewed in the direction indicated by the arrows.

Referring to FIGS. 1 and 2, there is illustrated an apparatus 10 of this invention which is designed to tow a surfer out into a body of water 12 from adjacent the shore 14. The apparatus 10 comprises, as major components, an anchor 16, a buoyant member 18 connected to the anchor 16, and an endless flexible line 20 extending from the buoyant member 18 to a location 22 adjacent the shore 14 where a capstan or windlass 24 is used to drive the flexible line 20. The apparatus 10 also includes means 26 for retrieving the buoyant member 18 from its operative position adjacent the anchor 16 to a location adjacent the shore 14.

The anchor 16 may be of any suitable type including the type which is embedded in the bottom 28. Preferably, however, the anchor 16 comprises a compartment 30 which is filled with heavy material such as metal, rock, concrete or the like. The exact weight of the anchor 16 depends to some degree on surf conditions but is conveniently in the range of 200–500 pounds. The anchor is positioned on the bottom 28 at a convenient distance from the shore 14. The exact placement of the anchor 16 depends on surf conditions and other variables as will be apparent to those skilled in the art. Typically, the anchor 16 would be placed in the range of 500–1000 feet from shore in water depths of 30–40 feet. Although the anchor 16 may be transported to its desired location in any suitable manner, it has been found convenient to place it on an inflatable raft, float it to its desired location and then deflate the raft.

The buoyant member 18 acts as a force transmitting connection between the endless flexible line 20 and the anchor 16. As shown best in FIG. 3, the buoyant member 18 comprises an elongate element 32 such as a treated wooden pole having an eye 34 on the lower end thereof and a cross-piece 36 on the upper end thereof. In the simplest form of the invention, a line 38 connects the eye 34 to the anchor 16 to tether the buoyant member 18. The buoyant member 18 is such that the cross-piece 36 is located adjacent the surface of the body of water 12 and carries a pair of pulleys 40, 42 at opposite ends of the cross-piece 36. It will be evident that the pulleys 40, 42 reside adjacent the surface of the water in the operative configuration of the apparatus 12.

Figure 3:
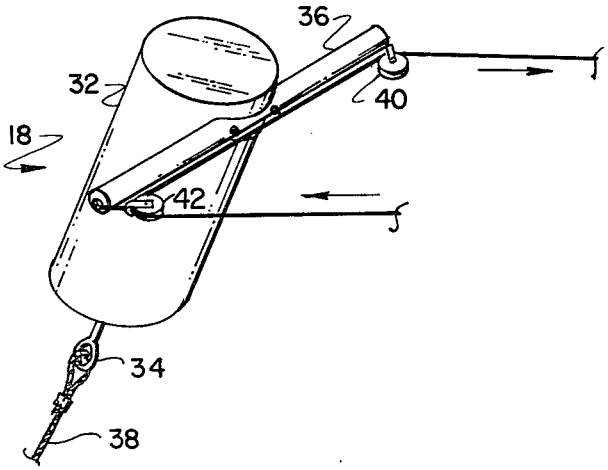
FIG. 3 is an enlarged isometric view of the buoyant member of FIGS. 1 and 2.
Figure 4:
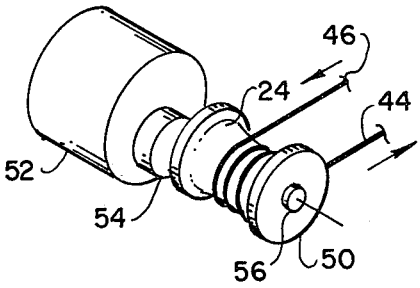
FIG. 4 is an enlarged isometric view of the driving mechanism of FIGS. 1 and 2.

As shown best in FIGS. 1 and 3, the flexible line 20 is reeved about the pulleys 40, 42 to establish first and second runs 44, 46 extending from the buoyant member 18 to the location 22. The pulleys 40, 42 are desirably spaced apart to avoid fouling of the runs 44, 46 during movement of the endless flexible line 20. Since the pulleys 40, 42 are typically spaced much farther apart than the width of the windless 24, the runs 44, 46 converge slightly toward the windlass 24.

The endless flexible line 20 may be of any suitable type such as chain, cable, heavy rope or the like but is preferably a fairly light weight marine rope such as is commercially available. Typical ropes of this type are floatable and comprise fibers of organc polymers such as polypropylene or the like. Spliced to the endless line 20 are a multiplicity of drop lines 48 which may be grasped by a surfer such that the surfer is towed toward the buoyant member 18 during operation of the capstan 24. The drop lines 48 should be fairly close together, e.g. every 10–40 feet, so that the surfer doesn't have to wait an inordinate length of time for a drop line 48 to come by. Conversely, the drop lines 48 should be spaced sufficiently far apart that a surfer will not be a hindrance to an individual immediately behind him. With these requirements in mind, design selections for the spacing of the drop lines 48 will normally be in the range of 10–25 feet. Since the endless line 20 is tensioned and driven by the windless 24, the endless line 20 describes a generally upwardly concave shape with the bulk of the line 20 floating near the surface of the water 12.

The windlass 24 includes a suitable drum 50 powered in any suitable fashion, as by the use of motor 52 and gear box 54 connected to the drum 50 by a shaft 56. In an extremely simple version of the apparatus 10, the power mechanism for the windlass 24 may comprise an automobile wheel rim. In this situation, one rear wheel of a motor vehicle is elevated off the ground, the elevated wheel is removed and replaced by a rim. The endless line 20 is wrapped about the rim. The motor vehicle engine is started and placed in gear which will rotate the elevated wheel in a desired direction to drive the endless line 20.

Operation of the apparatus 10 should now be fairly apparent. Referring to FIG. 1, the apparatus 10 is illustrated as set up in a typical surfing area. FIG. 1 illustrates a situation where the waves are moving in the direction indicated by the arrow 58 at a diagonal to the shore 14. Although the orientation of the apparatus 10 is illustrated in FIG. 1 as perpendicular to the shore 14, this may vary considerably. It is, however, much preferred that the axis 60 of the flexible line 20 be at an acute angle relative to the arrow 58 for purposes more fully explained hereinafter.

The capstan 50 is continuously driven in a direction such that the run 44 is outgoing in the sense that the line 20 moves away from the shore 14 on this portion of its travel with the run 46 being the return run. In this fashion, a surfer who is towed out to the buoyant member 18 can release the drop line 48 and ride the surf toward the shore 14 without having to cross over or otherwise contend with the endless line 20. It will accordingly be apparent that the angular relationship between the axis 60 of the endless line 20 and the direction of the seas indicated by the direction of the arrow 58 in conjunction with the use of the down sea run 44 as the outgoing portion of the line 20 greatly facilitates use of the apparatus 10 in a normal surfing situation.

In the embodiment of FIGS. 1 and 2, the retrieving means 26 also acts to connect the buoyant member 18 to the anchor 30. The retrieving means 26 includes an endless flexible line 62 which extends through an eye 64 carried by the anchor 16 and is wrapped several times about a brake 66 which may be a simple stake driven in the ground. An eye 68 is connected to the flexible line 62 and received the line 38 leading from the buoyant member 18.

It will be evident that there are times and conditions where it is desirable to temporarily retrieve the buoyant member 18. Typically, it is desirable to retrieve the buoyant member 18 at dark so that a passing boat does not become entangled in the flexible line 20. Other similar conditions may be readily envisioned.

In order to retrieve the buoyant member 18, the flexible line 62 is first unwrapped from the stake 66 or the stake 66 is pulled out of the ground. An individual merely pulls on the upper run of the endless line 62 which acts to pull the buoyant member 18 to shore. It will be evident that the endless line 20 and/or the buoyant member 18 may be stowed in any convenient fashion. Although the flexible line 62 remains in place, it is adjacent the bottom 28 and does not interfer with marine navigation. For this reason, the line 62 preferably does not float.

In its normal mode of operation, a person being towed out toward the buoy 18 lies down on the surf board and grasps the drop line 48. A more venturesome person may want to stand up on the surf board and, in effect, surf toward the buoy 18.

Although the invention has been described in its preferred form with a certain degree of particularity, it is understood that the present disclosure of the preferred form has been made only by way of example and that numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exists in the invention disclosed.

I claim:

1. Apparatus for towing individuals from adjacent a shore out into an adjacent body of water, comprising an anchor in the body of water;

a buoyant member connected to the anchor having a pulley thereon adjacent the surface of the water;

an endless flexible line reeved about the pulley and having two runs extending from the buoyant member to a location adjacent the shore;

means for endlessly moving the flexible line to drive one of the runs in a direction away from the location; and means operable from adjacent the shore for moving the buoyant member, pulley and flexible line from adjacent the anchor to adjacent the shore, the buoyant member moving means comprising first means carried by the anchor, a second endless line extending from adjacent the shore and reeved in the first means, and means adjacent the shore for anchoring the second line.

2. The apparatus of claim 1 wherein the endless line includes a plurality of drop lines having one end connected to the endless line and a free end which may be grasped by an individual.

3. The apparatus of claim 2 wherein the moving means comprises a capstan and means for rotating the capstan, the endless line being wrapped about the capstan.

4. The apparatus of claim 3 wherein the buoyant member comprises a cross piece, the first mentioned pulley being connected to the cross piece adjacent one end thereof, the buoyant member comprising a second pulley connected to the cross piece adjacent the other end thereof, the endless line being reeved over the first and second pulleys.

5. The apparatus of claim 1 wherein the second endless line does not float.

6. The apparatus of claim 5 wherein the first mentioned endless line is floatable.

7. The apparatus of claim 4 wherein the runs extend from the cross piece to the capstan, the pulleys being spaced apart sufficiently to diverge the runs toward the cross piece.

* * * * *